US008221561B2

(12) United States Patent
Gong et al.

(10) Patent No.: US 8,221,561 B2
(45) Date of Patent: Jul. 17, 2012

(54) AMORPHOUS ALLOYS HAVING ZIRCONIUM AND METHODS THEREOF

(75) Inventors: Qing Gong, Shenzhen (CN); Yongxi Jian, Shenzhen (CN); Faliang Zhang, Shenzhen (CN)

(73) Assignee: BYD Company Limited (CN)

( * ) Notice: Subject to any disclaimer, the term of this patent is extended or adjusted under 35 U.S.C. 154(b) by 0 days.

(21) Appl. No.: 13/310,128

(22) Filed: Dec. 2, 2011

(65) Prior Publication Data

US 2012/0073709 A1 Mar. 29, 2012

Related U.S. Application Data

(63) Continuation of application No. 12/890,063, filed on Sep. 24, 2010.

(30) Foreign Application Priority Data

Oct. 22, 2009 (CN) ..... 2009 1 0110323

(51) Int. Cl.
*C22C 45/10* (2006.01)

(52) U.S. Cl. ..... 148/403; 148/421; 420/423

(58) Field of Classification Search ..... None
See application file for complete search history.

(56) References Cited

U.S. PATENT DOCUMENTS

| | | | | |
|---|---|---|---|---|
| 6,374,899 | B1 * | 4/2002 | Yamaguchi et al. | 164/132 |
| 6,805,758 | B2 * | 10/2004 | Wolter | 148/403 |
| 2008/0190521 | A1 * | 8/2008 | Loffler et al. | 148/538 |

OTHER PUBLICATIONS

Jiang, F. et al., "Formation of Zr-based bulk metallic glasses from low purity materials by scandium addition", Scripta Materialia, vol. 53, pp. 487-491, Jun. 2005.*

* cited by examiner

*Primary Examiner* — George Wyszomierski
(74) *Attorney, Agent, or Firm* — Greenberg Traurig, LLP

(57) ABSTRACT

An amorphous alloy having the general formula of: $(Zr_xAl_yCu_zNi_{1-x-y-z})_{100-a-b}SC_aY_b$, wherein x, y, and z are atomic percents, and a and b are atom molar ratios, in which: about 0.45≦x≦about 0.60; about 0.08≦y≦about 0.12; about 0.25≦z≦about 0.35; 0<a≦about 5; and 0≦b<about 0.1.

10 Claims, 1 Drawing Sheet

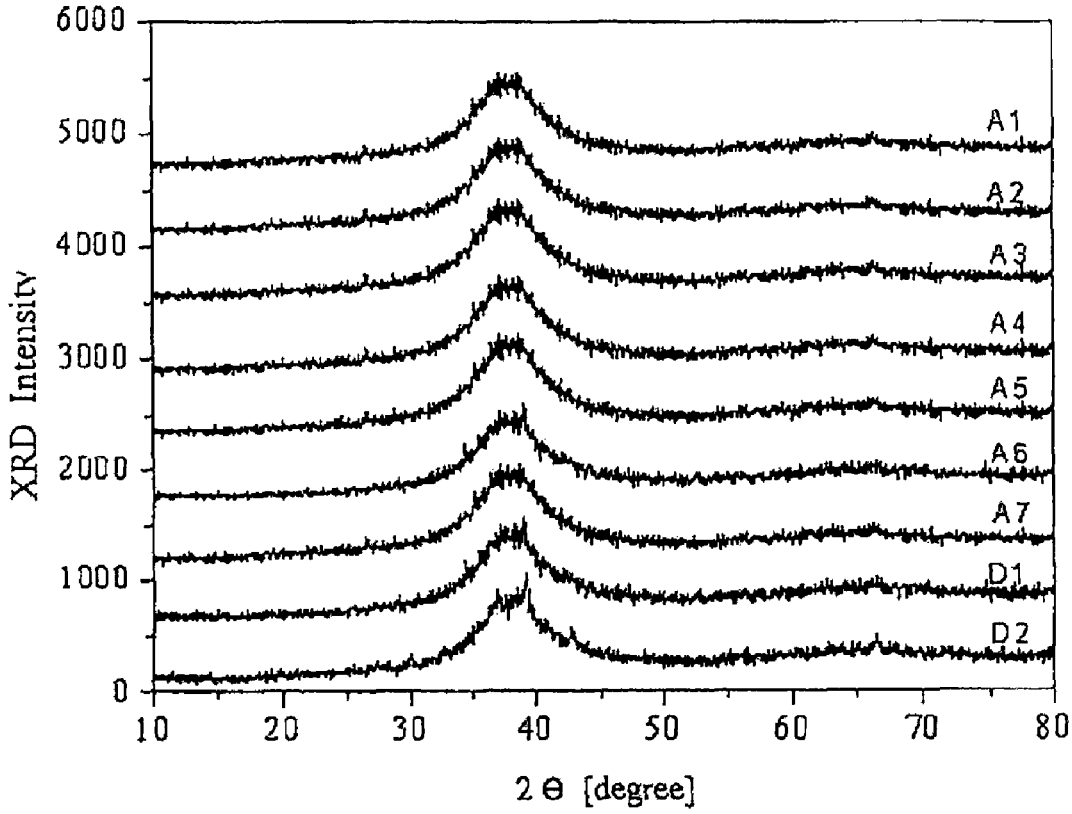
6000
5000
4000
3000
2000
1000
0
XRD Intensity
A1
A2
A3
A4
A5
A6
A7
D1
D2
10
20
30
40
50
60
70
80
2 θ [degree]

AMORPHOUS ALLOYS HAVING ZIRCONIUM AND METHODS THEREOF

CROSS-REFERENCE TO RELATED APPLICATION

This application is a continuation of prior U.S. patent application Ser. No. 12/890,063, filed Sep. 24, 2010, which claims the priority and benefit of Chinese Patent Application No. 200910110323.5 filed with State Intellectual Property Office, P. R. C. on Oct. 22, 2009.

FIELD OF DISCLOSURE

The present disclosure relates generally to amorphous alloys, and methods for preparing the same. More particularly, the present disclosure relates to amorphous alloys having zirconium, and methods for preparing the same.

BACKGROUND

Amorphous metallic alloys may have a generally disordered atomic-scale structure, which is in contrast to most metals that are often crystalline and have a generally organized atomic-scale structure. Amorphous metallic alloys may otherwise be referred to as "metallic glasses" or "glassy metals." Such alloys may be used in connection with a wide variety of applications, including, without limitation, in connection with golf clubs, industrial coatings and overlays, and cellular telephone technology.

SUMMARY

In accordance with various illustrative embodiments hereinafter disclosed are alloys, which may be represented by general formula of: $(Zr_xAl_yCu_zNi_{1-x-y-z})_{100-a-b}Sc_aY_b$, wherein x, y, and z are atomic percents, and a and b are atom molar ratios, in which: about $0.45 \leqq x \leqq$ about 0.60; about $0.08 \leqq y \leqq$ about 0.12; about $0.25 \leqq z \leqq$ about 0.35; $0 < a \leqq$ about 5; and $0 \leqq b <$ about 0.1.

In accordance with another illustrative embodiment hereinafter disclosed are methods of preparing alloys. The method may include melting one or more metals selected from the group consisting of: Zr; Al; Cu; Ni; Sc; and Y, to form a melted alloy. The method may further include molding the melted alloy with cooling to form an amorphous alloy; wherein the amorphous alloy is represented by the general formula of: $(Zr_xAl_yCu_zNi_{1-x-y-z})_{100-a-b}Sc_aY_b$, wherein x, y, and z are atomic percents, and a and b are atom molar ratios, in which: about $0.45 \leqq x \leqq$ about 0.60; about $0.08 \leqq y \leqq$ about 0.12; about $0.25 \leqq z \leqq$ about 0.35; $0 < a \leqq$ about 5; and $0 \leqq b <$ about 0.1.

While alloys such as amorphous alloys, and methods thereof, will be described in connection with various preferred illustrative embodiments, it will be understood that this disclosure is not intended to limit the alloys and methods thereof to those embodiments. On the contrary, this disclosure is intended to cover all alternatives, modifications, and equivalents as may be included within the spirit and scope of the alloys and methods as defined by the appended claims. Further, in the interest of clarification and without limitation, the numerical ranges provided herein are intended to be inclusive of all alternative ranges. As a non-limiting example, where a ratio of "about 1:about 0.1 to about 5" is provided, it is intended to disclose all intermediate ratios, including 1:0.11, 1:0.25, 1:1.3, 1:4.95, etc.

BRIEF DESCRIPTION OF THE DRAWING

The present alloys may be understood by reference to the following description taken in conjunction with the accompanying drawing, in which:

FIG. 1 illustrates X-ray diffraction patterns of exemplary alloys according to the present disclosure.

DETAILED DESCRIPTION OF THE EMBODIMENT

According to an aspect of the present disclosure, an alloy is provided which may include zirconium. The alloy may further be represented by the following general formula: $(Zr_xAl_yCu_zNi_{1-x-y-z})_{100-a-b}Sc_aY_b$, wherein x, y, and z are atomic percentages, and a and b are atomic molar ratios, in which: about $0.45 \leqq x \leqq$ about 0.60; about $0.08 \leqq y \leqq$ about 0.12; about $0.25 \leqq z \leqq$ about 0.35; $0 < a \leqq$ about 5; and $0 \leqq b <$ about 0.1. In an alternative embodiment, the alloy may be represented by the following general formula: $(Zr_xAl_yCu_zNi_{1-x-y-z})_{100-a-b}Sc_aY_b$, wherein x, y, and z are atomic percentages, and a and b are atomic molar ratios, in which: about $0.50 \leqq x \leqq$ about 0.55; about $0.08 \leqq y \leqq$ about 0.10; about $0.28 \leqq z \leqq$ about 0.32; $0 < a \leqq$ about 3; and about $0.05 \leqq b <$ about 0.1. In a still further alternative embodiment, the Zr-based amorphous alloy may be represented by the general formula of: $(Zr_{0.52}Al_{0.10}Cu_{0.305}Ni_{0.075})_{100-a-b}Sc_aY_b$, wherein a and b are atomic molar ratios, in which: $0 < a \leqq$ about 5 and $0 \leqq b <$ about 0.1.

In an embodiment, the above-described alloy may be an amorphous alloy. For the purposes of this disclosure, an "amorphous alloy" may mean a metallic alloy having a non-crystalline disordered atomic-scale structure.

According to another aspect of the present disclosure, a method for preparing the amorphous alloys of the present disclosure is provided. The method may comprise the following steps: melting a raw material having one or more metal selected from the group consisting of Zr, Al, Cu, Ni, Sc, and Y to form a melted alloy; and cooling/molding the melted alloy to form an amorphous alloy.

In an embodiment, the metals of the raw material may be selected in amounts sufficient to satisfy the above-described general formulas. Minor amounts of impurities may be present in the raw, and preferably the raw material may have an impurity content of less than about 5 atomic percent, based on the total weight of the amorphous alloy. Without wishing to be bound by the theory, Applicant believes that the greater the purity of the raw material, the easier it will be to form the amorphous alloy. In an embodiment, the raw material may have a purity of between about 95 wt % to about 100 wt %. In an embodiment, the raw material may have an oxygen content of less than about 1 atomic percent.

In an embodiment, the melting and molding steps may be performed in the presence of a protective gas or under vacuum conditions in order to protect the raw material from oxidation. The protective gas may be selected from the group consisting of helium, neon, argon, krypton, xenon, radon, nitrogen, and combinations thereof. The protective gas may have a purity greater than about 94 percent, by volume, and preferably has a purity of about 99.9 percent, by volume.

The melting step may be achieved by any known method, provided that the raw material is sufficiently melted. In an embodiment, the melting may be performed in a conventional melting device, such as an arc melting furnace or an induction melting furnace. The melting temperature and the melting time may vary according to different raw materials. In an embodiment of the present disclosure, the melting step may be performed when the raw material reaches a temperature ranging from about 1,200° C. to about 3,000° C. for about 0.5 minutes to about 5 minutes. In an alternative embodiment, the melting step may be performed at a temperature of about 1,200° C. to about 2,500° C. for about 1 minute to about 3 minutes. Additionally, in an embodiment, the meting device may be vacummed to a vacuum degree of less than about 1000 Pa before protective gas is introduced therein. In an embodiment, the melting and cooling/molding steps may be performed under vacuum with a vacuum degree of about 0.01 Pa to about 1000 Pa.

The amorphous alloy of the present disclosure may be cast relatively easily. The cooling/molding step may include those generally known to those skilled in the art, such as casting the melted alloy in a chilled, or continuously cooled, mold. Suitable casting methods may include: gravity casting; suction casting; spray casting; or die casting. In an embodiment, the mold may be made from copper alloy, stainless steel, and materials having a thermal conductivity ranging from between about 30 W/(m·K) to about 400 W/(m·K), and alternatively ranging from between about 50 W/(m·K) to about 200 W/(m·K). The mold may be cooled by water, oil, or liquid nitrogen, at a cooling speed sufficient such that the alloy undergoes cooling at rates greater than about 10 K/s. In an embodiment, the cooling speed may range from between about 10 K/s to about $10^4$ K/s.

In this way, the articles according to embodiments of this disclosure may have better glass formability and plastic deformability, and enhanced toughness and strength, without requiring strict preparing conditions.

EXAMPLES

The present disclosure will be further described with reference to the following examples wherein:

Example 1

An first exemplary alloy was prepared according to the following steps:

a) A raw material comprising about 50.44 atomic percent of Zr, about 9.7 atomic percent of Al, about 29.585 atomic percent of Cu, about 7.275 atomic percent of Ni, and about 3 atomic percent of Sc, each with a purity of about 95.5 wt % was placed in an arc melting furnace available from SKY Technology Development Co., Ltd., Chinese Academy of Sciences. The furnace was then vacuumed until a vacuum degree of about 5 Pa, and then nitrogen, with a purity of about 99.9% by volume, was introduced into the melting furnace as a protective gas. The raw material was melted at a temperature of about 1,300° C. for about 3 minutes to form a melted alloy.

b) The melted alloy was poured into a cylindrical copper mold by gravity casting, and the copper mold was cooled by water at a cooling speed of about $10^3$ K/s to form an amorphous alloy sample (hereinafter "A1"). Upon exiting the mold, A1 had a diameter of about 2 millimeters and a length of about 20 millimeters. A1 was tested using Inductively Coupled Plasma Atomic Emission Spectrometer ("ICP-AES") and was composed of $(Zr_{0.52}Al_{0.10}Cu_{0.305}Ni_{0.075})_{97}Sc_3$.

Comparative Example 1

A first comparative alloy was prepared according to the following steps:

a) A raw material comprising about 53.9 atomic percent of Zr, about 14.7 atomic percent of Al, about 19.6 atomic percent of Cu, about 9.8 atomic percent of Ni, and about 2 atomic percent of Y, each with a purity of about 95.5 wt % was placed in an arc melting furnace available from SKY Technology Development Co., Ltd., Chinese Academy of Sciences. The furnace was then vacuumed until a vacuum degree of about 5 Pa, and then nitrogen, with a purity of about 99.9% by volume, was introduced into the melting furnace as a protective gas. The raw material was melted at a temperature of about 1,300° C. for about 3 minutes to form a melted alloy.

b) The melted alloy was poured into a cylindrical copper mold by gravity casting, and cooled by water at a cooling speed of about $10^3$ K/s to form an amorphous alloy sample (hereinafter "D1"). Upon exiting the mold, D1 had a diameter of about 2 millimeters and a length of about 20 millimeters. D1 was tested using ICP-AES and was composed of $(Zr_{0.55}Al_{0.15}Cu_{0.20}Ni_{0.10})_{98}Y_2$.

Comparative Example 2

A second comparative alloy was prepared according to the following steps:

a) A raw material comprising about 30 atomic percent of Zr, about 5 atomic percent of Al, about 60 atomic percent of Cu, and about 5 atomic percent of Sc, each with a purity of about 95.5 wt % was placed in an arc melting furnace available from SKY Technology Development Co., Ltd., Chinese Academy of Sciences. The furnace was then vacuumed until a vacuum degree of about 5 Pa, and then nitrogen, with a purity of about 99.9% by volume, was introduced into the melting furnace as a protective gas. The raw material was melted at a temperature of about 1,300° C. for about 3 minutes to form a melted alloy.

b) The melted alloy was poured into a cylindrical copper mold by gravity casting, and cooled by water at a cooling speed of about $10^3$ K/s to form an amorphous alloy sample (hereinafter "D2"). Upon exiting the mold, D2 had a diameter of about 2 millimeters and a length of about 20 millimeters. D2 was tested using ICP-AES and was composed of $Cu_{60}Zr_{30}Al_5Sc_5$.

Example 2

A second exemplary alloy was prepared according to the following steps:

a) A raw material comprising about 51.74 atomic percent of Zr, about 9.95 atomic percent of Al, about 30.3475 atomic percent of Cu, about 7.4625 atomic percent of Ni, and about 0.5 atomic percent of Sc, each with a purity of about 95.5 wt % was placed in an arc melting furnace available from SKY Technology Development Co., Ltd., Chinese Academy of Sciences. The furnace was then vacuumed until a vacuum degree of about 5 Pa, and then nitrogen, with a purity of about 99.9% by volume, was introduced into the melting furnace as a protective gas. The raw material was melted at a temperature of about 1,300° C. for about 3 minutes to form a melted alloy.

b) The melted alloy was poured into a cylindrical copper mold by gravity casting, and cooled by water at a cooling speed of about $10^3$ K/s to form an amorphous alloy sample (hereinafter "A2"). Upon exiting the mold, A2 had a diameter of about 2 millimeters and a length of about 20 millimeters. A2 was tested using ICP-AES and was composed of $(Zr_{0.52}Al_{0.10}Cu_{0.305}Ni_{0.075})_{99.5}Sc_{0.5}$.

Example 3

A third exemplary alloy was prepared according to the following steps:

a) A raw material comprising about 49.4 atomic percent of Zr, about 9.5 atomic percent of Al, about 28.975 atomic percent of Cu, about 7.125 atomic percent of Ni, and about 5 atomic percent of Sc, each with a purity of about 95.5 wt % was placed in an arc melting furnace available from SKY Technology Development Co., Ltd., Chinese Academy of Sciences. The furnace was then vacuumed until a vacuum degree of about 5 Pa, and then nitrogen, with a purity of about 99.9% by volume, was introduced into the melting furnace as a protective gas. The raw material was melted at a temperature of about 1,300° C. for about 3 minutes to form a melted alloy.

b) The melted alloy was poured into a cylindrical copper mold by gravity casting, and cooled by water at a cooling speed of about $10^3$ K/s to form an amorphous alloy sample (hereinafter "A3"). Upon exiting the mold, A3 had a diameter of about 2 millimeters and a length of about 20 millimeters. A3 was tested using ICP-AES and was composed of $(Zr_{0.52}Al_{0.10}Cu_{0.305}Ni_{0.075})_{95}Sc_5$.

Example 4

A fourth exemplary alloy was prepared according to the following steps:

a) A raw material comprising about 48.5 atomic percent of Zr, about 9.7 atomic percent of Al, about 29.1 atomic percent of Cu, about 9.7 atomic percent of Ni, and about 3 atomic percent of Sc, each with a purity of about 95.5 wt % was placed in an arc melting furnace available from SKY Technology Development Co., Ltd., Chinese Academy of Sciences. The furnace was vacuumed until a vacuum degree of about 5 Pa, and then nitrogen, with a purity of about 99.9% by volume, was introduced into the melting furnace as a protective gas. The raw material was melted at a temperature of about 1,300° C. for about 3 minutes to form a melted alloy.

b) The melted alloy was poured into a cylindrical copper mold by gravity casting, and cooled by water at a cooling speed of about $10^3$ K/s to form an amorphous alloy sample (hereinafter "A4"). Upon exiting the mold, A4 had a diameter of about 2 millimeters and a length of about 20 millimeters. A4 was tested using ICP-AES and was composed of $(Zr_{0.5}Al_{0.1}Cu_{0.3}Ni_{0.1})_{97}Sc_3$.

Example 5

A fifth exemplary alloy was prepared according to the following steps:

a) A raw material comprising about 43.6275 atomic percent of Zr, about 9.695 atomic percent of Al, about 33.9325 atomic percent of Cu, about 9.695 atomic percent of Ni, about 3 atomic percent of Sc, and about 0.05 atomic percent of Y, each with a purity of about 95.5 wt % was placed in an arc melting furnace available from SKY Technology Development Co., Ltd., Chinese Academy of Sciences. The furnace was then vacuumed until a vacuum degree of about 5 Pa, and then nitrogen, with a purity of about 99.9% by volume, was introduced into the melting furnace as a protective gas. The raw material was melted at a temperature of about 1,300° C. for about 3 minutes to form a melted alloy.

b) The melted alloy was poured into a cylindrical copper mold by gravity casting, and cooled by water at a cooling speed of about $10^3$ K/s to form an amorphous alloy sample (hereinafter "A5"). Upon exiting the mold, A5 had a diameter of about 2 millimeters and a length of about 20 millimeters. A5 was tested using ICP-AES and was composed of $(Zr_{0.45}Al_{0.1}Cu_{0.35}Ni_{0.1})_{96.95}Sc_3Y_{0.05}$.

Example 6

A sixth exemplary alloy was prepared according to the following steps:

a) A raw material comprising about 50.3932 atomic percent of Zr, about 9.691 atomic percent of Al, about 29.55755 atomic percent of Cu, about 7.26825 atomic percent of Ni, about 3 atomic percent of Sc, and about 0.09 atomic percent of Y, each with a purity of about 95.5 wt % was placed in an arc melting furnace available from SKY Technology Development Co., Ltd., Chinese Academy of Sciences. The furnace was then vacuumed until a vacuum degree of about 5 Pa, and then nitrogen, with a purity of about 99.9% by volume, was introduced into the melting furnace as a protective gas. The raw material was melted at a temperature of about 1,300° C. for about 3 minutes to form a melted alloy.

b) The melted alloy was poured into a cylindrical copper mold by gravity casting, and cooled by water at a cooling speed of about $10^3$ K/s to form an amorphous alloy sample (hereinafter "A6"). Upon exiting the mold, A6 had a diameter of about 2 millimeters and a length of about 20 millimeters. A6 was tested using ICP-AES and was composed of $(Zr_{0.52}Al_{0.10}Cu_{0.305}Ni_{0.075})_{96.91}Sc_3Y_{0.09}$.

Example 7

A seventh exemplary alloy was prepared according to the following steps:

a) A raw material comprising about 53.9 atomic percent of Zr, about 14.7 atomic percent of Al, about 19.6 atomic percent of Cu, about 9.8 atomic percent of Ni, and about 2 atomic percent of Y, each with a purity of about 95.5 wt % was placed in an arc melting furnace available from SKY Technology Development Co., Ltd., Chinese Academy of Sciences. The furnace was then vacuumed until a vacuum degree of about 10 Pa, and then nitrogen, with a purity of about 99.9% by volume, was introduced into the melting furnace as a protective gas. The raw material was melted at a temperature of about 1,500° C. for about 2.5 minutes to form a melted alloy.

b) The melted alloy was poured into a cylindrical copper mold by gravity casting, and cooled by water at a cooling speed of about $2\times10^3$ K/s to form an amorphous alloy sample (hereinafter "A7"). Upon exiting the mold, A7 had a diameter of about 2 millimeters and a length of about millimeters. A7 was tested using ICP-AES and was composed of $(Zr_{0.52}Al_{0.10}Cu_{0.305}Ni_{0.075})_{97}Sc_3$.

Testing

1) X-Ray Diffraction

A1-A7 and D1-D2 were tested by an D-MAX2200PC X-ray powder diffractometer under conditions of: a copper target, an incident wavelength of about 1.54060 Å, an accelerating voltage of about 40 KV, a current of about 20 mA, a scanning step of about 0.04° respectively. FIG. 1 illustrates that A1 and A2 were amorphous. A3-A7 were additional found to be amorphous.

2) Impact Toughness

Impact toughness was performed on ZBC1000 pendulum impact tester available from Shenzhen sans Materials Testing Co., Ltd., P.R.C. Each of A1-A7 and D1-A2 were cut to obtain a U-shape gap with a length of about 2 millimeters. The samples were then tested by Charpy Pendulum Impact Test Method according to GBT 229-2007 to obtain the impact toughness provided for in Table 1.

3) Compressive Fracture Strength and Stress-Strain Curve

A1-A7 and D1-D2 were cut into an alloy bar having an about 1 millimeter diameter and a length of about 2 millimeters. The alloy bars were tested using a CMT5105 Electronic Universal Testing Machine to obtain compressive fracture strengths and stress-strain curves of the samples respectively. Maximum plastic strains values were calculated from the respective stress-strain curves. The results are provided in Table 1.

TABLE 1

| No. | Composition | Impact Toughness ($KJ/m^2$) | Compressive Fracture Strength (MPa) | Maximum Plastic Strain Values (percent) |
|---|---|---|---|---|
| A1 | $(Zr_{0.52}Al_{0.10}Cu_{0.305}Ni_{0.075})_{97}Sc_3$ | 162.515 | 2855 | 20 |
| D1 | $(Zr_{0.55}Al_{0.15}Cu_{0.20}Ni_{0.10})_{98}Y_2$ | 73.368 | 2188 | 1.5 |
| D2 | $Cu_{30}Zr_{60}A_5Sc_5$ | 58.442 | 1849 | 0 |
| A2 | $(Zr_{0.52}Al_{0.10}Cu_{0.305}Ni_{0.075})_{99.5}Sc_{0.5}$ | 138.291 | 2316 | 11 |
| A3 | $(Zr_{0.52}Al_{0.10}Cu_{0.305}Ni_{0.075})_{95}Sc_5$ | 143.217 | 2729 | 13 |
| A4 | $(Zr_{0.5}Al_{0.1}Cu_{0.3}Ni_{0.1})_{97}Sc_3$ | 150.585 | 2566 | 11 |
| A5 | $(Zr_{0.45}Al_{0.1}Cu_{0.35}Ni_{0.1})_{96.95}Sc_3Y_{0.05}$ | 139.458 | 2458 | 14 |
| A6 | $(Zr_{0.52}Al_{0.10}Cu_{0.305}Ni_{0.075})_{96.91}Sc_{3.}Y_{0.09}$ | 144.256 | 2644 | 15 |
| A7 | $(Zr_{0.52}Al_{0.10}Cu_{0.305}Ni_{0.075})_{97}Sc_3$ | 150.177 | 2659 | 17 |

Although explanatory embodiments have been shown and described, it would be appreciated by those skilled in the art that changes, alternatives, and modifications all falling into the scope of the claims and their equivalents can be made in the embodiments without departing from spirit and principles of the disclosure.

What is claimed is:

1. An amorphous alloy having a general formula of:

$(Zr_xAl_yCu_zNi_{1-x-y-z})_{100-a-b}Sc_aY_b$, wherein x, y, and z are atomic percents, and a and b are atom molar ratios, in which: about $0.5 \leqq x \leqq$ about 0.55; about $0.08 \leqq y \leqq$ about 0.10; about $0.28 \leqq z \leqq$ about 0.32; $0 < a \leqq$ about 3; and $0.05 \leqq b <$ about 0.1.

2. The amorphous alloy of claim 1, represented by the general formula of:

$(Zr_{0.52}Al_{0.10}Cu_{0.305}Ni_{0.075})_{100-a-b}SC_aY_b$.

3. The amorphous alloy of claim 1 having an impact toughness ranging from between about 80 $KJ/m^2$ to about 170 $KJ/m^2$.

4. The amorphous alloy of claim 1 having an impact toughness greater than about 100 $KJ/m^2$.

5. The amorphous alloy of claim 1 having a fracture strength greater than about 2200 MPa.

6. The amorphous alloy of claim 1 having a fracture strength greater than about 2500 MPa.

7. The amorphous alloy of claim 1 having a fracture strength greater than about 2800 MPa.

8. The amorphous alloy of claim 1 having a maximum plastic strains value ranging from between about 2% to about 20%.

9. The amorphous alloy of claim 1 having a maximum plastic strains value greater than about 11%.

10. The amorphous alloy of claim 1 having a maximum plastic strains value greater than about 15%.

* * * * *